US007914135B2

(12) United States Patent
Wanibe

(10) Patent No.: US 7,914,135 B2
(45) Date of Patent: Mar. 29, 2011

(54) LIQUID CARTRIDGE AND CIRCUIT BOARD

(75) Inventor: Akihisa Wanibe, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 810 days.

(21) Appl. No.: 11/691,139

(22) Filed: Mar. 26, 2007

(65) Prior Publication Data

US 2007/0222838 A1 Sep. 27, 2007

(30) Foreign Application Priority Data

Mar. 27, 2006 (JP) ..... P2006-085319
Mar. 15, 2007 (JP) ..... P2007-067613

(51) Int. Cl.
*B41J 2/175* (2006.01)

(52) U.S. Cl. ..... 347/86

(58) Field of Classification Search ..... None
See application file for complete search history.

(56) References Cited

U.S. PATENT DOCUMENTS 4,878,070 A * 10/1989 Watrobski ..... 347/58
6,499,839 B1 * 12/2002 Busby et al. ..... 347/96
2006/0219726 A1 10/2006 Yajima et al.

FOREIGN PATENT DOCUMENTS

JP 2001-212976 A 8/2001
JP 2001212976 A * 8/2001
JP 2004-090624 A 3/2004
JP 2006-075997 A 3/2006

OTHER PUBLICATIONS

International Search Report with partial English translation from Int'l Appln. No. PCT/JP2007/056487 dated May 1, 2007.

* cited by examiner

*Primary Examiner* — Stephen D Meier
*Assistant Examiner* — Alexander C Witkowski
(74) *Attorney, Agent, or Firm* — Stroock & Stroock & Lavan LLP

(57) ABSTRACT

A liquid cartridge mountable on a cartridge mounting portion of a liquid consuming apparatus, the liquid cartridge includes: a circuit board that is attached to an outer surface of the liquid cartridge in an insertion direction of the liquid cartridge into the cartridge mounting portion; and a connection terminal that is formed in the circuit board to be contactable with a connector provided in the cartridge mounting portion, wherein the circuit board has a positioning hole that is formed at a front end side in the insertion direction into the cartridge mounting portion, and an error absorption hole that is formed at a base end side in the insertion direction and has a larger opening area than that of the positioning hole, and the positioning hole is engaged with a positioning boss that is provided in the liquid cartridge, the error absorption hole is engaged with an error absorption boss that is provided in the liquid cartridge, and the circuit board is fixed to a container main body by thermally caulking the bosses.

16 Claims, 8 Drawing Sheets

LIQUID CARTRIDGE AND CIRCUIT BOARD

BACKGROUND

1. Technical Field

The present invention relates to a liquid cartridge that has a circuit board, which has a memory device mounted on a rear surface thereof and is attached to an outer surface of the liquid cartridge in an insertion direction of a resin container main body to be inserted into and mounted on a cartridge mounting portion of a liquid consuming apparatus, and a connection terminal, which is formed on a surface of the circuit board to be contactable with a connector provided in the cartridge mounting portion, thereby allowing the liquid consuming apparatus to read and write information with respect to the memory device.

2. Related Art

A liquid consuming apparatus includes all kinds of apparatuses that consume a liquid supplied from a predetermined portion during the operation. As a representative liquid jetting apparatus, a liquid ejecting apparatus that ejects liquid droplets from an ejecting head is exemplified. Moreover, the liquid ejecting apparatus is not limited to a recording apparatus, such as an ink jet recording apparatus, a copy machine, or a facsimile machine, which ejects ink from a recording head as a liquid ejecting head to a recording material, such as a recording sheet or the like. For example, the liquid consuming apparatus may be an apparatus that ejects a liquid for a specific purpose, instead of ink, from a liquid ejecting head corresponding to the above-described recording head to a material to be ejected corresponding to the recording material, and causes the liquid to be attached to the material to be ejected. In addition, the liquid ejecting head includes, in addition to the above-described recording head, a color material ejecting head that is used to manufacture color filters of a liquid crystal display or the like, an electrode material (conductive paste) ejecting head that is used to form electrodes of an organic electroluminescent (EL) display or a surface emission display (FED), a bioorganic compound ejecting head that is used to manufacture a bio-chip, a sample ejecting head that ejects a sample as a precision pipette, and so on.

The ink jet recording apparatus sends ink, which is stored in an ink cartridge mounted on a cartridge mounting portion in the apparatus to a recording head. The recording head ejects and coats ink droplets to a recording medium, such as a recording sheet or the like, thereby recording images or characters.

In the ink jet recording apparatus, the recording head controls the ejection of the ink droplets using heat or vibration. If idle printing occurs in a state where ink in the ink cartridge is exhausted and ink is not supplied, the recording head may be damaged.

Accordingly, in the ink jet recording apparatus, in order to prevent idle printing of the recording head, it is necessary to monitor the residual quantity of an ink liquid in the ink cartridge.

Further, when the use conditions, for example, full color photograph printing, monochrome text printing, and the like, are different from each other, a difference in color or quantity of an ink liquid to be consumed occurs. Accordingly, in a recent ink jet recording apparatus, some of a plurality of ink cartridges mounted on the apparatus is changed to the ink cartridges according to the use conditions. In such an ink jet recording apparatus, it is necessary to manage the use history regarding whether the ink cartridge mounted on the cartridge mounting portion is a new one or whether a previously used one is remounted.

From such a background, there is suggested an ink cartridge as shown in FIGS. 7 and 8.

An ink cartridge 1 includes a resin container main body 3 that is inserted into and mounted on a cartridge mounting portion 2 of an ink jet recording apparatus, and a circuit board (IC board) 4 that is mounted on an outer surface 3*a* in an insertion direction of the container main body 3 (an up and down direction in the drawings).

The container main body 3 is an injection-molded product formed of resin. Inside the container main body 3 is formed a liquid storage portion 3*b* that stores ink to be supplied to the ink jet recording apparatus. A liquid supply port 3*c* is formed at a lower surface of the container main body 3 so as to supply ink stored in the liquid storage portion 3*b* to the ink jet recording apparatus.

The circuit board 4 substantially has a rectangular plate shape. As shown in FIG. 9, a memory device (IC chip) 5 is mounted on a rear surface of the circuit board 4. Connection terminals 7 are formed on a front surface of the circuit board 4 so as to serve as input/output terminals with respect to the memory device 5. The connection terminals 7 are pressed into contact with electrical connector terminals 8 provided in the cartridge mounting portion 2 when the ink cartridge 1 is inserted into and mounted on the cartridge mounting portion 2. Accordingly, a control circuit of the recording apparatus connected to the connector terminals 8 can read and write information with respect to the memory device 5.

In such an ink cartridge 1, it is possible to easily manage the ink residual quantity of the recording apparatus by writing information, such as the ink residual quantity or the use history, to the memory device 5.

Until now, the circuit board 4 is attached to the container main body 3 by fitting bosses protruding from the outer surface 3*a* of the container main body 3 into mounting holes and thermally caulking the front ends of the bosses.

Specifically, the circuit board 4 is provided with an error absorption notched hole 4*a* and an oval positioning hole 4*b* as the mounting holes on the outer surface 3*a*. The error absorption notched hole 4*a* is provided at the front end side in the insertion direction into the cartridge mounting portion 2 (in FIG. 8, on a lower side) to have an oval shape in the insertion direction. The oval positioning hole 4*b* is provided at the base end side in the insertion direction. Then, on the outer surface 3*a* of the container main body 3 are provided an oval boss 9 that substantially has an oval cross-sectional shape corresponding to the error absorption notched hole 4*a* and a circular boss 10 that substantially has a circular cross-sectional shape corresponding to the positioning hole 4*b*.

Here, the bosses 9 and 10 are correspondingly fitted into the mounting holes 4*a* and 4*b* of the circuit board 4, and then the front ends of the bosses 9 and 10 protruding from the front ends of the mounting holes 4*a* and 4*b* are thermally fastened. Then, the circuit board 4 is fixed to the outer surface 3*a* of the container main body 3.

As shown in FIGS. 7 and 8, when a lever member 11 is provided on the outer surface 3*a*, on which the circuit board 4 is provided, so as to anchor the container main body 3 to the cartridge mounting portion 2, the connector terminals 8 are disposed to lean toward the front end side in the insertion direction so as not to interfere with the lever member 11 (see FIG. 9). For this reason, the connection terminals 7 that are provided on the circuit board 4 are also disposed to lean toward the front end side in the insertion direction (that is, on the side of the underlying error absorption notched hole 4*a*) (for example, see Patent Document 1).

Patent Document 1: JP-A-2004-90624

However, the elution area of the oval boss 9 by thermal caulking is larger than that of the circular boss 10, and as shown in an enlarged view of FIG. 9, a long eluted portion 9*a* is formed in the insertion direction.

In the known ink cartridge 1 in which the oval boss 9 is located at the front end side in the insertion direction, when the ink cartridge 1 is inserted into and mounted on the cartridge mounting portion 2, the long eluted portion 9*a* may rub against the connector terminals 8, which causes resin fractions. Then, the resin fractions may be stuck to the connection terminals 7, and thus defective contact may occur between the connector terminals 8 and the connection terminals 7.

In order to prevent the resin fractions, instead of the oval boss 9, a circular boss having a small cross-sectional shape may be provided. In this case, however, the boss may interfere with other parts and be easily damaged at the front end side in the insertion direction into the cartridge mounting portion 2, that is, at the corner of the cartridge main body 3. Accordingly, a boss having an oval shape is formed in order to improve mechanical strength.

The error absorption notched hole 4*a*, into which the oval boss 9 is fitted, is formed by a two-stage processing shown in FIGS. 10A and 10B. That is, as shown in FIG. 10A, first, a circular hole 12*a* is formed using a drill or the like. Then, a square hole 12*b* is punched by a punching die to extend to a lower edge of the board at the width of the circular hole 12*a*. During punching the square hole 12*b*, a positional shift Ks or a burr Kb easily occurs.

The error absorption notched hole 4*a* absorbs a size tolerance of the circuit board 4, and thus its size is set in advance such that the oval boss 9 is loose-fitted thereinto. However, as described above, since the positional shift Ks or the burr Kb occurs, size accuracy is easily deteriorated. Accordingly, as shown in FIG. 4B, when the circuit board 4 is positioned, deflection (positional shift) F1 or F2 occurs with the circular boss 10 as a rotation fulcrum.

As a result, positioning accuracy of the connection terminals 7 disposed on the side of the error absorption notched hole 4*a* having large deflection F1 or F2 is lowered, and defective contact may occur with respect to the connector terminals 8.

SUMMARY

An object of the invention is to provide a liquid cartridge that can increase position accuracy of connection terminals on a circuit board to be mounted on an outer surface of a container main body and, when inserted into and mounted on a cartridge mounting portion of a liquid consuming apparatus, can suppress fractions from being generated when an eluted portion of a boss for fixing the circuit board to the container main body rubs against connector terminals in the cartridge mounting portion and reliably connect the connection terminals of the circuit board with the connector terminals.

According to a first aspect of the invention, a liquid cartridge mountable on a cartridge mounting portion of a liquid consuming apparatus, includes: a circuit board that is attached to an outer surface of the liquid cartridge in an insertion direction of the liquid cartridge into the cartridge mounting portion; and a connection terminal that is formed in the circuit board to be contactable with a connector provided in the cartridge mounting portion, wherein the circuit board has a positioning hole that is formed at a front end side in the insertion direction into the cartridge mounting portion, and an error absorption hole that is formed at a base end side in the insertion direction and has a larger opening area than that of the positioning hole, and the positioning hole is engaged with a positioning boss that is provided in the liquid cartridge, the error absorption hole is engaged with an error absorption boss that is provided in the liquid cartridge, and the circuit board is fixed to a container main body by thermally caulking the bosses.

In the liquid cartridge according to the first aspect of the invention, the circuit board may be configured such that the connection terminal is formed between the positioning hole and the error absorption hole so as to be close to the positioning hole.

In the liquid cartridge according to the first aspect of the invention, the error absorption hole may be a notch or may be a through hole that passes through the circuit board.

According to a second aspect of the invention, a circuit board attachable to a liquid cartridge, includes: a connection terminal; a positioning hole; and an error absorption hole that has a larger opening area than that of the positioning hole, wherein the connection terminal is formed between the positioning hole and the error absorption hole to be close to the positioning hole.

In the circuit board according to the second aspect of the invention, the error absorption hole may be a notch or may be a through hole that passes through the circuit board.

According to a third aspect of the invention, a liquid cartridge, includes: a circuit board that is attached to an outer surface of the liquid cartridge in an insertion direction of a resin container main body to be inserted into and mounted on a cartridge mounting portion of a liquid consuming apparatus; and a connection terminal that is formed in the circuit board to be contactable with a connector of the cartridge mounting portion, wherein the circuit board has a circular positioning hole that is formed at a front end side in the insertion direction into the cartridge mounting portion, and an oval error absorption notched hole that is formed at a base end side in the insertion direction, and the circular positioning hole is engaged with a circular boss that is provided in the container main body, the error absorption notched hole is engaged with an oval boss that is provided in the container main body, and the circuit board is fixed to the container main body by thermally caulking the bosses.

In the liquid cartridge according to the third aspect of the invention, the circuit board may be configured such that the connection terminals are formed between the circular positioning hole and the error absorption notched hole to be close to the circular positioning hole.

In the liquid cartridge according to the invention, it is common to the related art in that the fixation of the circuit board to the container main body is performed by engaging two holes formed in the circuit board with the bosses at the corresponding places of the container main body and thermally caulking the front ends of the bosses. However, in the liquid cartridge according to the invention, the hole that is formed at the front end side in the insertion direction of the circuit board is set as the positioning hole, and the hole that is formed at the base end side in the insertion direction is set as the error absorption hole having a larger opening area than the positioning hole. Then, the holes are engaged with the positioning boss and the error absorption boss. For this reason, when the liquid cartridge is inserted into and mounted on the cartridge mounting portion of the liquid consuming apparatus, a boss that rubs against the connector terminals in the cartridge mounting portion is the positioning boss having an eluted portion of a small area. Therefore, a distance at which the eluted portion rubs against the connector terminals when the liquid cartridge is inserted into the cartridge mounting portion is reduced.

As a result, fractions can be suppressed from being generated when the eluted portion of the boss for fixing the circuit board to the container main body rubs against the connector terminal in the cartridge mounting portion. Further, defective contact can be prevented from occurring since the fractions are stuck to the connection terminal or the like. Therefore, the circuit board can be reliably connected with the connector terminal. Then, it is possible to accurately manage the residual quantity of a liquid in the liquid cartridge by allowing the liquid consuming apparatus to read and write information with respect to a memory device mounted on the circuit board.

The circuit board is attached to the container main body such that the side of the error absorption hole is deflected with the position boss, which is fitted into the positioning hole provided at the front end side in the insertion direction, as the rotation fulcrum. Accordingly, the connection terminals are provided near the positioning hole having high position accuracy. Therefore, it is possible to increase position accuracy of the connection terminals with respect to the connector terminals. Further, it is possible to reliably connect the connection terminals of the circuit board with the connector terminals.

In the circuit board according to the invention, the connection terminals are formed between the positioning hole and the error absorption hole to be close to the positioning hole. Therefore, it is possible to increase position accuracy of the connection terminal with respect to the connector terminal. Further, it is possible to reliably connect the connection terminal of the circuit board with the connector terminals.

The present disclosure relates to the subject matter contained in Japanese patent application Nos. 2006-085319 filed on Mar. 27, 2006 and 2007-67613 filed on Mar. 15, 2006, which are expressly incorporated herein by reference in its entirety.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, preferred embodiments of a liquid cartridge according to the invention will be described in detail with reference to the drawings.

Figure 1:
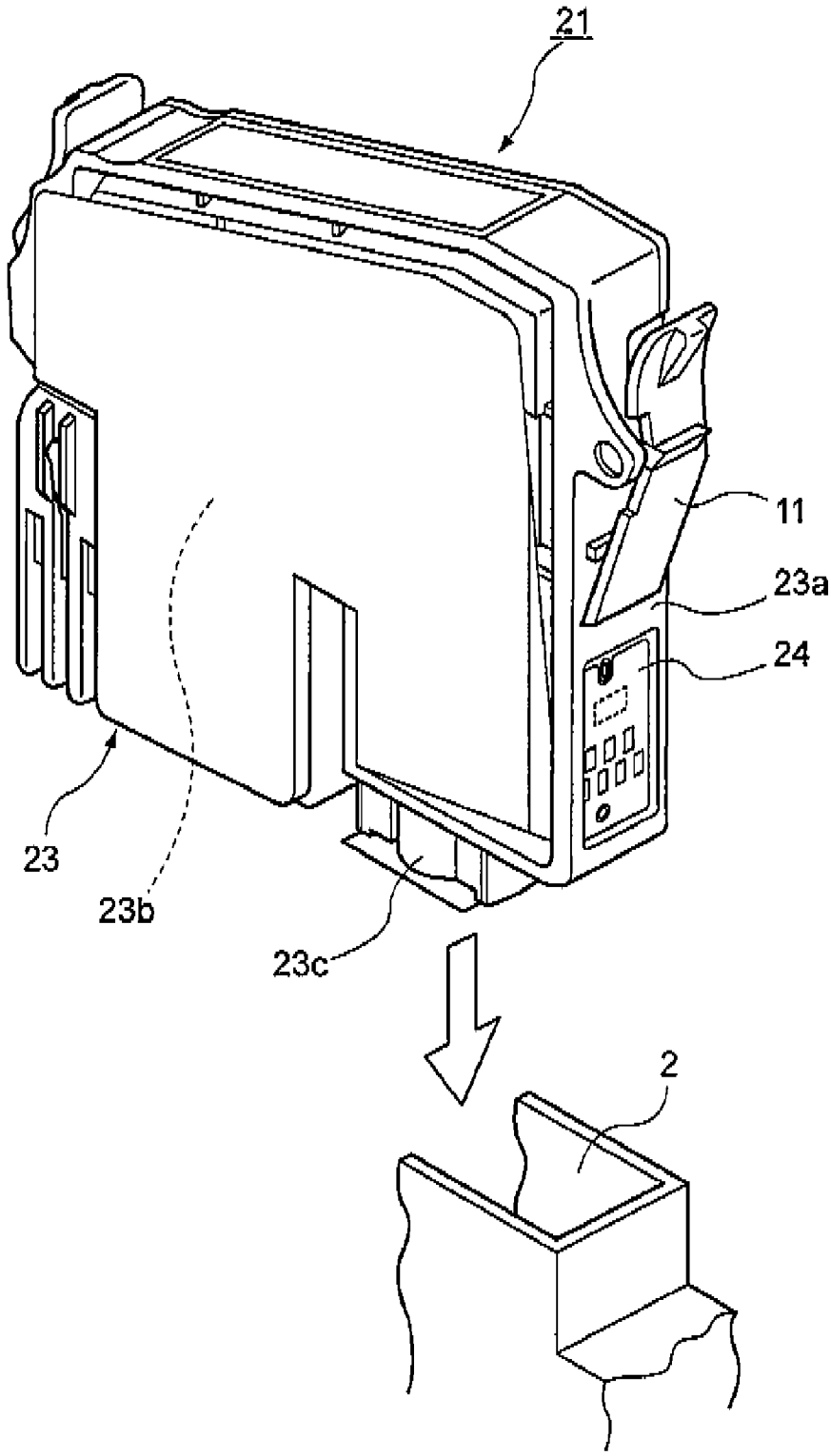
FIG. 1 is a perspective view of an ink cartridge as an embodiment of a liquid cartridge according to the invention.
Figure 2:
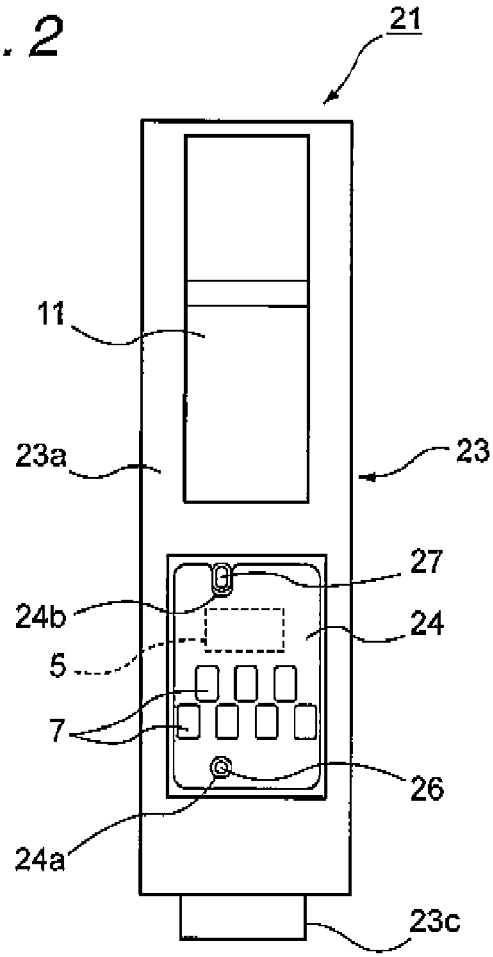
FIG. 2 is a front view of a container outer surface on which a circuit board of the ink cartridge shown in FIG. 1 is provided.
Figure 3:
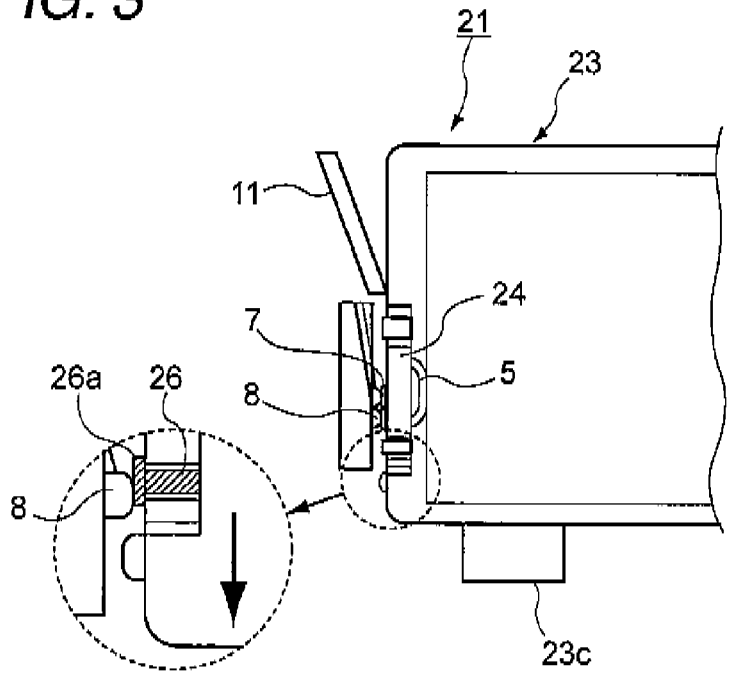
FIG. 3 is a cross-sectional view showing essential parts in a state where the ink cartridge shown in FIG. 1 is mounted on a cartridge mounting portion, and an enlarged view of the essential parts.

FIG. 1 is a perspective view of an ink cartridge as an embodiment of the liquid cartridge according to the invention. FIG. 2 is a front view of a container outer surface on which a circuit board of the ink cartridge shown in FIG. 1 is provided. FIG. 3 is a cross-sectional view showing essential parts in a state where the ink cartridge shown in FIG. 1 is mounted on a cartridge mounting portion, and an enlarged view of the essential parts.

An ink cartridge 21 according to this embodiment includes a container main body 23 that is formed of resin and inserted into and mounted on a cartridge mounting portion 2 of an ink jet recording apparatus as a liquid consuming apparatus, and a circuit board (IC board) 24 that is mounted on a vertical outer surface 23*a* in an insertion direction of the container main body 23 (in an up and down direction in the drawing).

The container main body 23 is an injection-molded article formed of resin. Inside the container main body 23 is formed a liquid storage portion 23*b* that stores ink to be supplied to the ink jet recording apparatus. A liquid supply port 23*c* is formed at a lower surface of the container main body 23 so as to supply ink stored in the liquid storage portion 23*b* to the ink jet recording apparatus. On the outer surface 23*a* on which the circuit board 24 is mounted, a lever member 11 is integrally formed to be engaged with an engagement mechanism (not shown) provided in the cartridge mounting portion 2 above a mounting position of the circuit board 24, thereby fixing the ink cartridge 21 to the cartridge mounting portion 2.

The circuit board 24 substantially has a rectangular plate shape. As shown in FIG. 3, a memory device (IC chip) 5 is mounted on a rear surface of the circuit board 24. Connection terminals 7 are formed on a front surface of the circuit board 24 so as to serve as input/output terminals of the memory device 5.

In this embodiment, like the related art, the circuit board 24 is attached to the container main body 23 by fitting two bosses protruding from the outer surface 23*a* of the container main body 23 into two holes (hereinafter, also referred to as mounting holes) formed in the circuit board 24 and thermally caulking the front ends of the bosses.

Meanwhile, as shown in FIG. 2, in the circuit board 24, as the mounting holes with respect to the outer surface 23*a*, a circular positioning hole 24*a* is provided at a front end side in the insertion direction into the cartridge mounting portion 2 (a lower side in FIG. 2), and an error absorption hole 24*b* (notch) is provided at a base end side in the insertion direction to be notched in an oval shape in the insertion direction.

On the outer surface 23*a* of the container main body 23, a circular boss (positioning boss) 26 is provided at the front end side in the insertion direction to have a substantially circular cross-sectional shape corresponding to the positioning hole 24*a*, and an oval boss (error absorption boss) 27 is provided at the base end side in the insertion direction to have a substantially oval shape corresponding to the error absorption hole 24*b*.

Figure 5A:
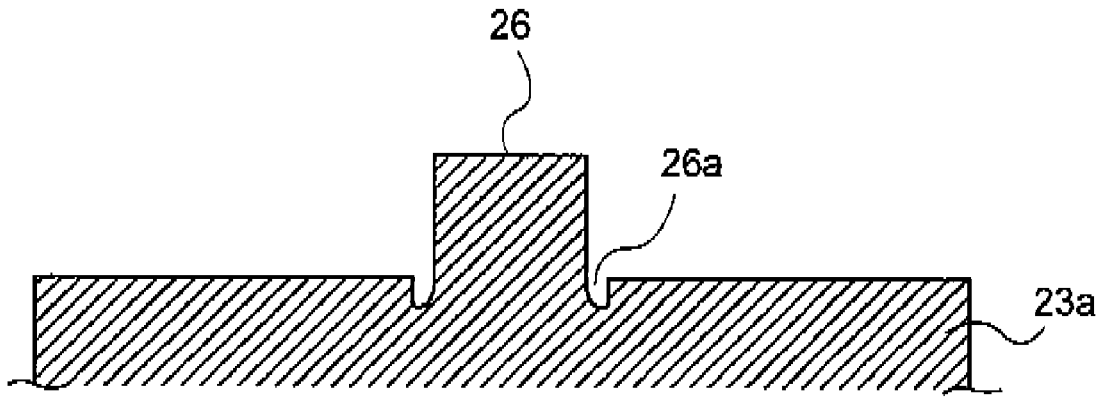
FIG. 5A is a cross-sectional view illustrating the shape of a circular boss shown in FIG. 2.
Figure 5B:
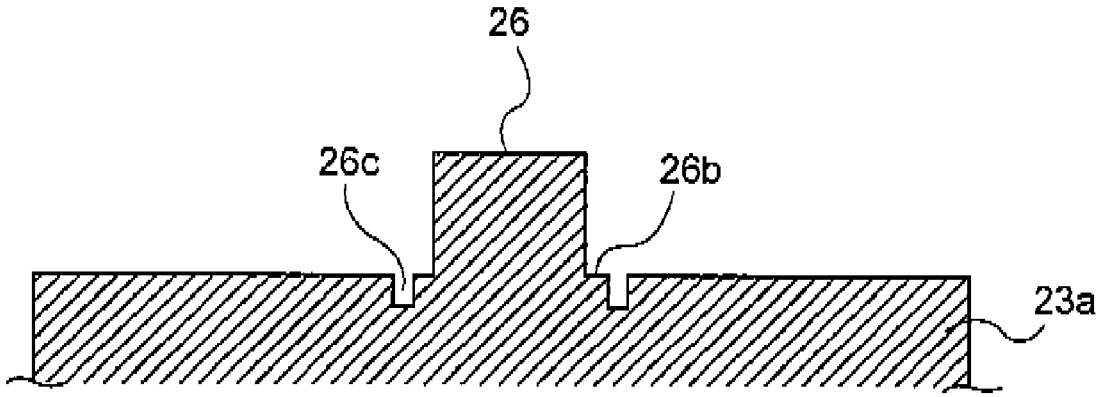
FIG. 5B is a cross-sectional view showing the shape of another circular boss.

In this embodiment, as shown in FIG. 5A or 5B, the circuit boss 26 that is provided at a corner of the container main body 23 is formed such that a base portion has a large diameter, thereby improving mechanical strength. That is, in FIG. 5A, a hem portion as the base portion of the circuit boss 26 is formed as an R portion having a gradually increasing diameter. When the R portion is simply formed, it is necessary to form a release portion of the R portion in the mounting hole of the circuit board 24 into which the boss is fitted. Accordingly, a counter bore 26*a* is formed on the outer surface 23*a* of the container main body 23 to be connected to the R portion. Similarly, in FIG. 5B, a circular boss 26 has a step 26*b* in the base portion, and a counter bore 26*c* is formed around the step 26*b*.

With this configuration, in the related art, a boss that is provided at the corner of the container main body 3 and likely to be damaged due to the interference with other parts can have increased mechanical strength.

Next, the bosses 26 and 27 are correspondingly fitted into the mounting holes 24*a* and 24*b* of the circuit board 24, and then the front ends of the bosses 26 and 27 protruding from the front ends of the individual mounting holes 24*a* and 24*b* are thermally fastened, thereby fixing the circuit board 24 to the container main body 23.

In the circuit board 24 of this embodiment, the connection terminals 7 are formed between the positioning hole 24*a* and the error absorption notched hole 24*b*. Further, the individual connection terminals 7 are collectively disposed to be close to the positioning hole 24*a* at the front end side in the insertion direction.

This is because the lever member 11 is provided on the outer surface 23*a* of the container main body 23 on which the circuit board 24 is provided, and connector terminals 8 serving as a connector provided in the cartridge mounting portion 2 is disposed to lean toward the front end side in the insertion direction so as not to interfere with the lever member 11.

As shown in FIG. 3, when the ink cartridge 21 is inserted into and mounted on the cartridge mounting portion 2, the connection terminals 7 on the circuit board 24 are pressed into contact with the electrical connector terminals 8 provided in the cartridge mounting portion 2. Accordingly, a control circuit of the recording apparatus connected to the connector terminals 8 can read and write information with respect to the memory device 5.

In such an ink cartridge 21, it is possible to easily manage the ink residual quantity of the recording apparatus by writing information, such as the ink residual quantity or the use history, to the memory device 5.

In the ink cartridge 21 of this embodiment described above, it is common to the related art in that the circuit board 24 is fixed to the container main body 23 by correspondingly fitting the bosses of the container main body 23 into the two mounting holes formed in the circuit board 24 and thermally caulking the front ends of the bosses. Meanwhile, in the ink cartridge 1 of this embodiment, a mounting hole that is formed at the front end side in the insertion direction of the circuit board 24 is set as the positioning hole 24*a*, and a mounting hole that is formed at the base end side in the insertion direction is set as the error absorption hole 24*b* having a larger opening area than the positioning hole 24*a*. Then, the circular boss 26 and the oval boss 27 are correspondingly fitted into the mounting holes.

For this reason, when the ink cartridge 21 is inserted into and mounted on the cartridge mounting portion 2 of the liquid consuming apparatus, a boss that rubs against the connector terminals 8 in the cartridge mounting portion 2 is the positioning boss having an eluted portion 26*a* of a small area, as shown in FIG. 3. Therefore, a distance at which the eluted portion 26*a* rubs against the connector terminals 8 when the ink cartridge 21 is inserted into the cartridge mounting portion 2 is reduced.

As a result, fractions can be suppressed from being generated when the eluted portion 26*a* of the boss for fixing the circuit board 24 to the container main body 23 rubs against the connector terminals 8 in the cartridge mounting portion 2. Further, defective contact can be prevented from occurring since the fractions are stuck to the connection terminals 7 or the like. Therefore, the connection terminals 7 of the circuit board 24 can be reliably connected with the connector terminals 8. Then, it is possible to accurately manage the residual quantity of a liquid in the ink cartridge 21 by allowing the ink jet recording apparatus to read and write information with respect to the memory device 5 mounted on the circuit board 24.

Figure 4A:
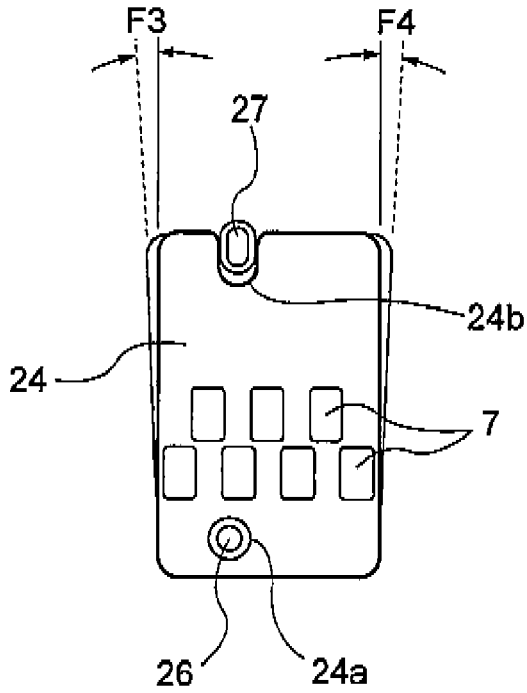
FIG. 4A is an explanatory view of position accuracy of connection terminals on a container main body shown in FIG. 2.
Figure 4B:
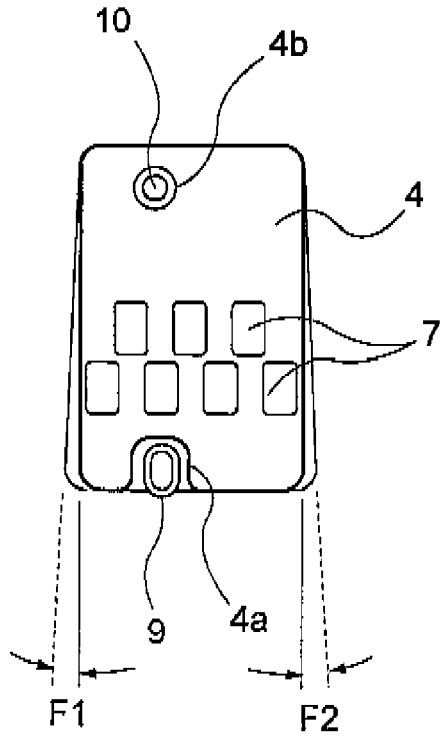
FIG. 4B is an explanatory view of position accuracy of connection terminals on a known ink cartridge.

As shown in FIG. 4A, the circuit board 24 attached to the container main body 23 is configured such that the side of the error absorption notched hole 24*b* is deflected at a deflection width F3 or F4 with the circuit boss 26 fitted into the positioning hole 24*a* as a rotation fulcrum. Accordingly, position accuracy is lowered at a position closer to the error absorption notched hole 24*b*.

However, like the above-described embodiment, if the connection terminals 7 are collected to be close to the positioning hole 24*a* at the front end side in the insertion direction, deflection can be suppressed from being generated in the connection terminals 7. Therefore, it is possible to increase position accuracy of the connection terminals 7 with respect to the connector terminals 8. As a result, it is possible to reliably connect the connection terminals 7 of the circuit board 24 with the connector terminals 8.

In the liquid cartridge of the invention, the shapes of the positioning hole, the error absorption hole, the positioning boss, and the error absorption boss are not limited to the shapes of the above-described embodiment. Various shapes can be used without departing from the spirit of the invention.

Figure 6A:
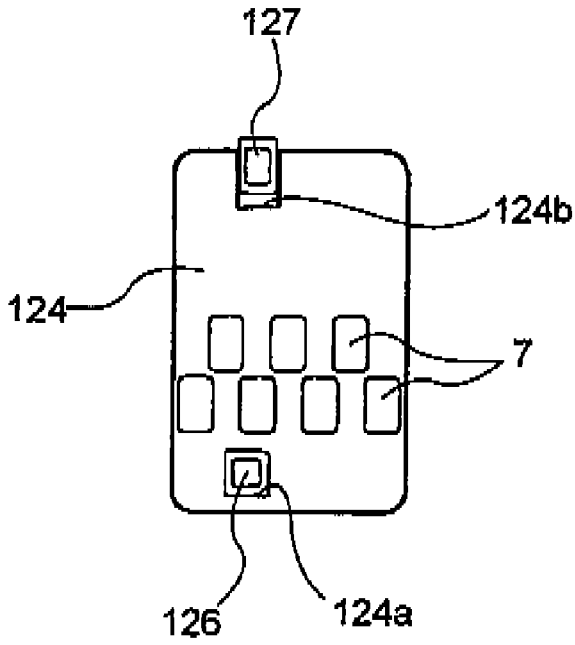
FIG. 6A is a front view of a circuit board showing a modification of a positioning boss and an error absorption boss.

For example, in a circuit board 124 shown in FIG. 6A, a square positioning hole 124*a* is provided at the front end side in the insertion direction into the cartridge mounting portion 2 (on a lower side in FIGS. 6A and 68), and an error absorption hole 124*b* is provided at the base end side in the insertion direction to be notched in a rectangular shape in the insertion direction.

On the outer surface 23*a* of the container main body 23, a square boss (positioning boss) 126 is provided at the front end side in the insertion direction to have a substantially square cross-sectional shape corresponding to the positioning hole 124*a*, and a rectangular boss (error absorption boss) 127 is provided at the base end side in the insertion direction to have a substantially rectangular shape corresponding to the error absorption hole 124*b*.

Figure 6B:
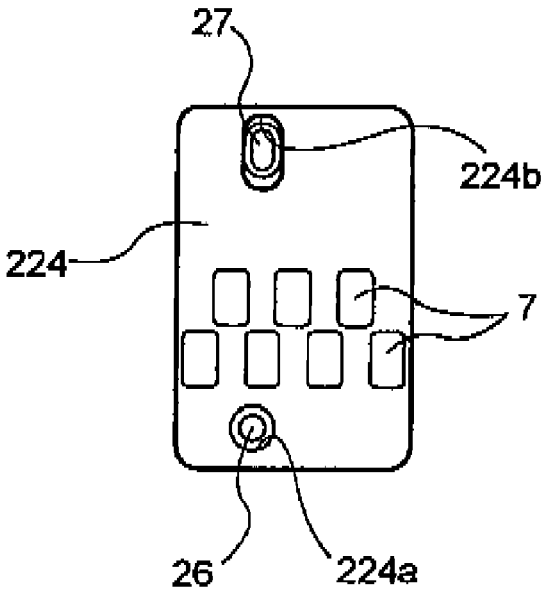
FIG. 6B is a front view of a circuit board showing a modification of an error absorption hole.
Figure 7:
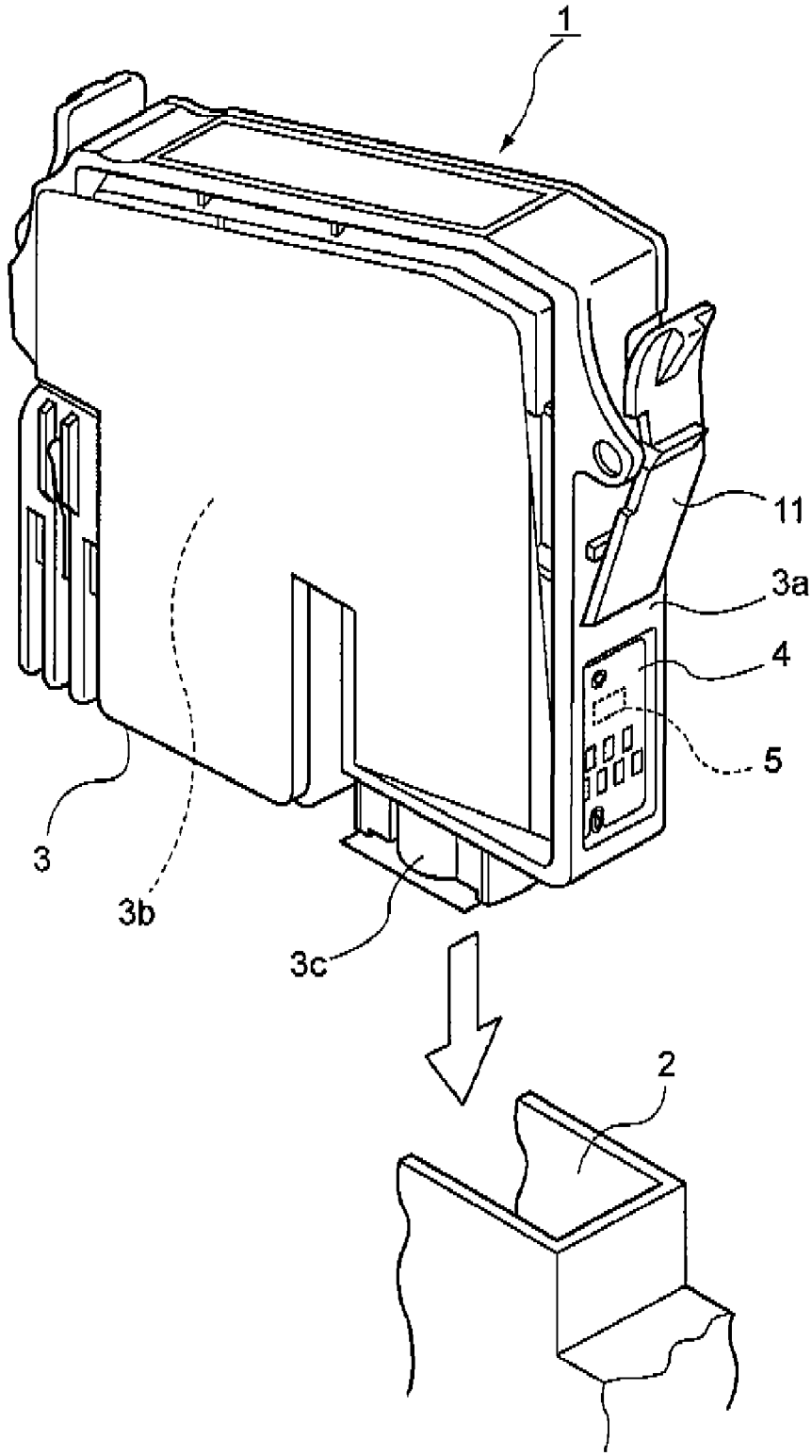
FIG. 7 is a perspective view of an ink cartridge as an example of a known liquid cartridge.
Figure 8:
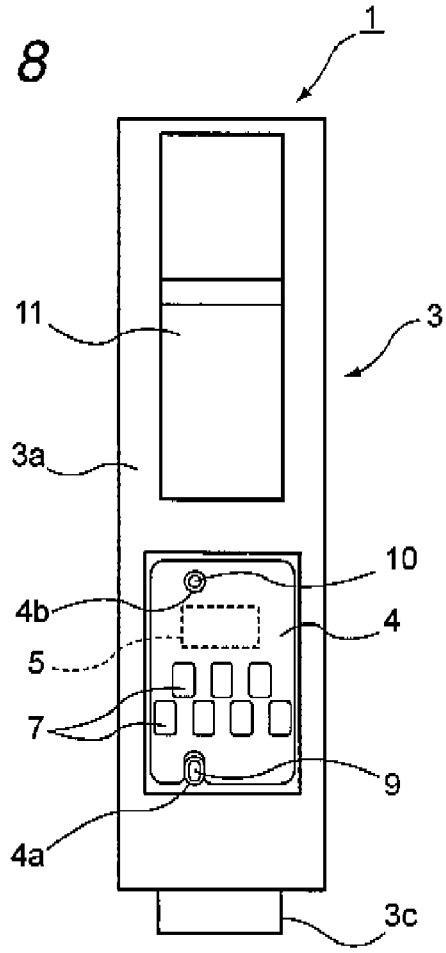
FIG. 8 is a front view of a container outer surface on which a circuit board of the ink cartridge shown in FIG. 7 is provided.
Figure 9:
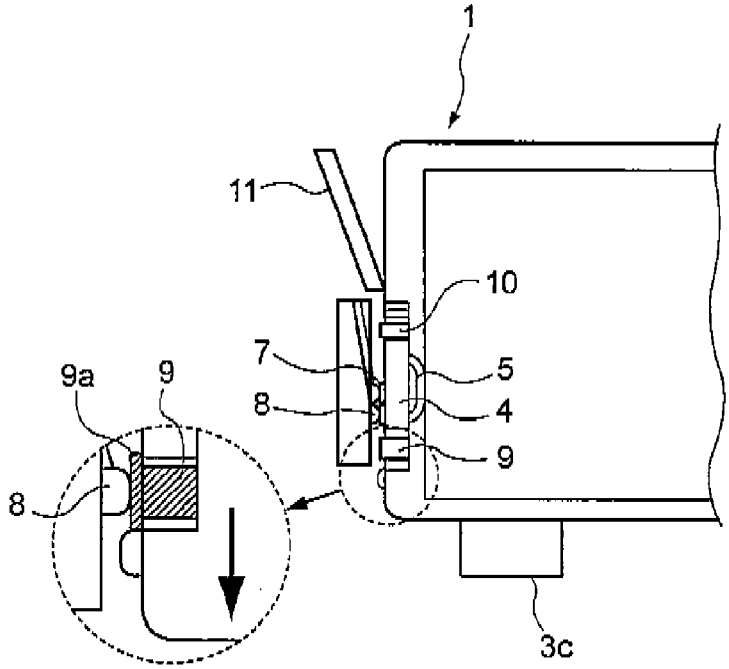
FIG. 9 is a cross-sectional view showing essential parts in a state where the ink cartridge shown in FIG. 7 is mounted on a cartridge mounting portion, and an enlarged view of the essential parts.
Figure 10A:
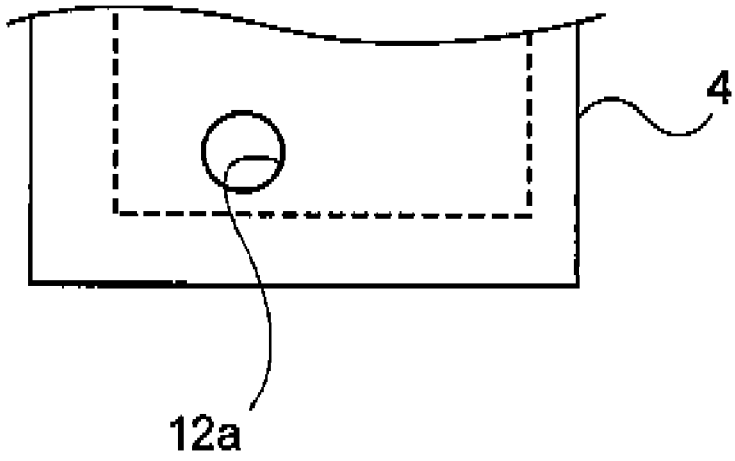
FIG. 10A is a plan view of a circuit board showing a first step of a processing of an error absorption notched hole.
Figure 10B:
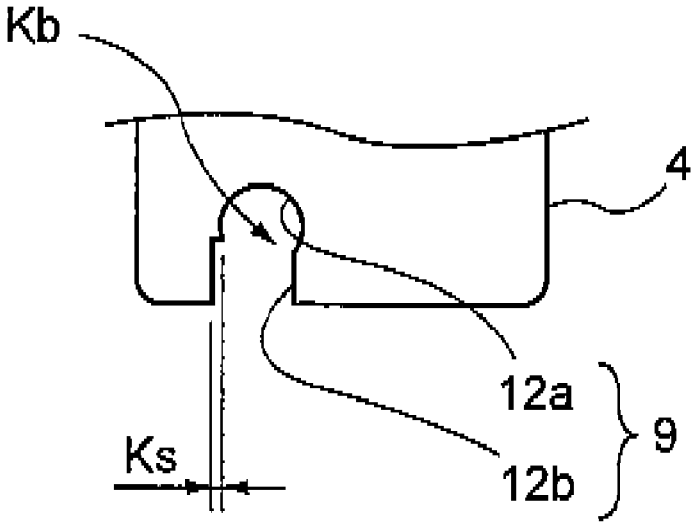
FIG. 10B is a plan view of a circuit board showing a second step of the processing.

In a circuit board 224 shown in FIG. 6B, a circular positioning hole 224*a* is provided at the front end side in the insertion direction into the cartridge mounting portion 2, and an oval error absorption hole 124*b* (through hole) is provided at the base end side in the insertion direction to have an oval shape in the insertion direction.

On the outer surface 23*a* of the container main body 23, a circular boss (positioning boss) 26 is provided at the front end side in the insertion direction to have a substantially circular cross-sectional shape corresponding to the positioning hole 224*a*, and an oval boss (error absorption boss) 27 is provided at the base end side in the insertion direction to have a substantially oval shape corresponding to the error absorption hole 224*b*.

The use of the liquid cartridge according to the invention is not limited to the ink cartridge in the above-described embodiment. Further, the liquid consuming apparatus having the cartridge mounting portion, on which the liquid cartridge according to the invention is mounted, is not limited to the ink jet recording apparatus in the above-described embodiment.

Various liquid consuming apparatuses that have the cartridge mounting portion, on which the liquid cartridge is detachably mounted, and are supplied with the liquid stored in the liquid cartridge. Specific examples of the liquid consuming apparatus include an apparatus having a color material jetting head used in manufacturing color filters of a liquid crystal display or the like, an apparatus having an electrode material (conductive paste) jetting head used in forming electrodes of an organic electroluminescent (EL) display or a surface emission display (FED), an apparatus having a bioorganic compound jetting head used in manufacturing a biochip, an apparatus having a sample spraying head as a precision pipette, a textile printing apparatus, or a micro dispenser.

What is claimed is:

1. A liquid cartridge adapted to be inserted into a cartridge mounting portion of a liquid consuming apparatus, the liquid cartridge comprising:

a first boss;

a second boss;

a circuit board provided on an outer surface of the liquid cartridge; and a connection terminal provided on the circuit board and configured to be brought into contact with a connector provided in the cartridge mounting portion when the liquid cartridge is inserted in the cartridge mounting portion, the circuit board has a first side portion which is to be first inserted into the cartridge mounting portion when the liquid cartridge is inserted in the cartridge mounting portion, and a second side portion which is to be inserted into the cartridge mounting portion later than the first side when the liquid cartridge is inserted in the cartridge mounting portion;

wherein the circuit board has a first opening formed in the first side portion and having a first opening area, and a second opening formed in the second side portion and having a second opening area larger than first opening area;

the first opening receives the first boss, and the second opening receives the second boss; and the connection terminal is disposed between the first opening and the second opening at a position closer to the second opening.

2. The liquid cartridge according to claim 1, wherein the second opening is a notch.

3. The liquid cartridge according to claim 1, wherein the second opening is a through hole extending through the circuit board.

4. The liquid cartridge according to claim 1, wherein a recess is formed on the liquid cartridge so as to surround a base portion of the first boss.

5. The liquid cartridge according to claim 4, wherein a diameter of a part of the first boss surrounded by the recess is enlarged.

6. A circuit board adapted to be attached on a liquid cartridge, the circuit board comprising:

a connection terminal;

first opening having a first opening area, and configured to receive a first boss provided on the liquid cartridge when the circuit board is attached on the liquid cartridge; and a second opening having a second opening area larger than the first opening area, and configured to receive a second boss provided on the liquid cartridge when the circuit board is attached on the liquid cartridge, wherein the connection terminal is disposed between the first opening and the second opening at a position closer to the first opening than the second opening.

7. The circuit board according to claim 6, wherein the second opening is a notch.

8. The circuit board according to claim 6, wherein the second opening is a through hole extending through the circuit board.

9. A liquid cartridge adapted to be inserted into a cartridge mounting portion of a liquid consuming apparatus, the liquid cartridge comprising:

a first boss having a circular cross sectional part;

a second boss having an oval cross sectional part;

a circuit board provided on an outer surface of the liquid cartridge; and a connection terminal provided on the circuit board and configured to be brought into contact with a connector provided in the cartridge mounting portion when the liquid cartridge is inserted into the cartridge mounting portion, wherein the circuit board has a first side portion which is to be first inserted into the cartridge mounting portion when the liquid cartridge is inserted in the cartridge mounting portion, and a second side portion which is to be inserted into the cartridge mounting portion later than the first side when the liquid cartridge is inserted in the cartridge mounting portion;

the circuit board has a circular opening formed in the first side portion, and an oval opening formed in the second side portion, the circular opening is engaged with the first boss, and the oval opening is engaged with the second boss; and the connection terminal is disposed between the circular opening and the oval opening at a position closer to the circular opening than the oval opening.

10. The liquid cartridge according to claim 9, wherein the oval opening is a notch.

11. The liquid cartridge according to claim 9, wherein the oval opening is a through hole extending through the circuit board.

12. The liquid cartridge according to claim 9, wherein a recess is formed on the liquid cartridge so as to surround a base portion of the first boss.

13. The liquid cartridge according to claim 12, wherein a diameter of a part of the first boss surrounded by the recess is enlarged.

14. A circuit bard adapted to be attached on a liquid cartridge, the circuit board comprising:

a connection terminal;

a circular opening having a first opening area, and configured to receive a first boss provided on the liquid cartridge when the circuit board is attached on the liquid cartridge; and an oval opening having a second opening area larger than the first opening area, and configured to receive a second boss provided on the liquid cartridge when the circuit board is attached on the liquid cartridge, wherein the connection terminal is disposed between the circular opening and the oval opening at a position closer to the circular opening than the oval opening.

15. The circuit board according to claim 14, wherein the oval opening is a notch.

16. The circuit board according to claim 14, wherein the oval opening is a through hole extending through the circuit board.

* * * * *